US009286857B2

(12) United States Patent
Lin et al.

(10) Patent No.: US 9,286,857 B2
(45) Date of Patent: Mar. 15, 2016

(54) DISPLAY APPARATUS AND METHOD FOR TRANSFORMING COLOR THEREOF

(71) Applicant: Au Optronics Corporation, Hsinchu (TW)

(72) Inventors: Hui-Feng Lin, Taichung (TW); Shang-Yu Su, New Taipei (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 14/526,514

(22) Filed: Oct. 29, 2014

(65) Prior Publication Data

US 2016/0049134 A1 Feb. 18, 2016

(30) Foreign Application Priority Data

Aug. 18, 2014 (TW) ..... 103128284 A

(51) Int. Cl.

*G09G 3/36* (2006.01)
*G09G 5/02* (2006.01)
*G09G 5/10* (2006.01)

(52) U.S. Cl.

CPC ..... *G09G 5/02* (2013.01); *G09G 3/3611* (2013.01); *G09G 5/10* (2013.01)

(58) Field of Classification Search

CPC . G09G 3/2003; G09G 3/3611; G09G 3/3607; G09G 3/3413; G09G 5/10

USPC ..... 345/87, 88, 102, 690

See application file for complete search history.

(56) References Cited

U.S. PATENT DOCUMENTS

2011/0057950 A1* 3/2011 Kim et al. ..... G09G 5/02 345/602
2014/0176617 A1* 6/2014 Jeong ..... G09G 3/2003 345/690

FOREIGN PATENT DOCUMENTS

TW 200705315 2/2007

* cited by examiner

*Primary Examiner* — Jennifer Nguyen
(74) *Attorney, Agent, or Firm* — Jianq Chyun IP Office

(57) ABSTRACT

A display apparatus and a method for transforming color thereof are provided. The display apparatus includes a display panel having a red sub-pixel, a blue sub-pixel, a green sub-pixel and a white sub-pixel, a driver circuit for driving the red sub-pixel, the blue sub-pixel, the green sub-pixel and the white sub-pixel, and a data processing unit. The data processing unit receives a red original data, a blue original data and a green original data to produce a red reference data, a green reference data and a white reference data to the driver circuit as a red data, a green data and a white data, and regulate a produced blue reference data thereof according to a blue component brightness corresponding to the white reference data to provide the a blue data to the driver circuit.

25 Claims, 4 Drawing Sheets

100

DISPLAY APPARATUS AND METHOD FOR TRANSFORMING COLOR THEREOF

CROSS-REFERENCE TO RELATED APPLICATION

This application claims the priority benefit of Taiwan application serial no. 103128284, filed on Aug. 18, 2014. The entirety of the above-mentioned patent application is hereby incorporated by reference herein and made a part of this specification.

BACKGROUND

1. Field of the Invention

The invention is directed to a display apparatus and a method for color transforming thereof and more particularly, to a four-color display apparatus and a method for color transforming thereof.

2. Description of Related Art

Recently, portable electronic products and flat panel displays become popularized along with the increasing development of semiconductor technology. Among various types of flat panel displays, a liquid crystal display (LCD) has become the mainstream of display products in virtue of its many advantages, such as low-voltage operation, no scattering radiation, light weight, and small volume. Meanwhile, a multi-primary color display has been developed to increase a color gamut range of the display. Unlike a trichromatic display utilizing three colors, red, green and blue, to achieve a color-mixing effect, the multi-primary color display utilizes four or more colors to achieve the color-mixing effect, and in this way, the multi-primary color display can have a wider color gamut range.

In general circumstances, all LCD displays have to be processed by color temperature compensation before being manufactured, so as to maintain white color temperature of the LCD displays within a specified color temperature (CT) range, e.g., 11000±500° K (for LCD TVs). In terms of a multi-primary color display utilizing four colors, red (R), green (G), blue (B) and white (W) to achieve the color-mixing effect, the multi-primary color display processed by the color temperature compensation commonly has reduced brightness of the blue component (i.e., reduced gray level value of the blue color), such that the while color temperature can be maintained in a specified CT range. However, part of white color displayed in the multi-primary color display contains the blue component, and as a result, the multi-primary color display processed by the color temperature compensation has a color shift issue.

SUMMARY

The invention provides a display apparatus and a method for color transforming thereof capable of mitigating a color shift issue occurring in a multi-primary color display.

The invention is directed to a display apparatus, including a display panel, a driving circuit and a data processing unit. The display panel has a red sub-pixel, a blue sub-pixel, a green sub-pixel and a white sub-pixel. The driving circuit is electrically connected with the display panel and receives red data, blue data, green data and white data to drive a red sub-pixel, a blue sub-pixel, a green sub-pixel and a white sub-pixel. The data processing unit receives red original data, blue original data and green original data to produce red reference data, blue reference data, green reference data and white reference data, outputs the red reference data, the green reference data and the white reference data to serve as the red data, the green data and the white data and regulates the blue reference data according to blue component brightness corresponding to the white reference data to provide the blue data.

In an embodiment of the invention, the data processing unit includes a numerical calculating unit and a data transforming unit. The numerical calculating unit receives the red original data, the blue original data and the green original data to determine a backlight mapping ratio. The data transforming unit receives the red original data, the blue original data, the green original data and the backlight mapping ratio to produce the red reference data, the blue reference data, the green reference data and the white reference data, outputs the red reference data, the green reference data and the white reference data to serve as the red data, the green data and the white data and regulates the blue reference data according to the blue component brightness corresponding to the white reference data to provide blue data.

In an embodiment of the invention, the numerical calculating unit includes an image analysis unit, a boundary adjustment unit, a backlight calculating unit, a mapping ratio transforming unit and a mapping ratio determining unit. The image analysis unit receives the red original data, the blue original data and the green original data to obtain a maximum brightness reference value and a minimum brightness reference value from brightness values corresponding to the red original data, the blue original data and the green original data. The boundary adjustment unit is electrically connected with the image analysis unit to receive the maximum brightness reference value and the minimum brightness reference value and provide a first product of the maximum brightness reference value multiplied by a first regulation coefficient and a second product of the minimum brightness reference value multiplied by a second regulation coefficient. The backlight calculating unit is electrically connected with the boundary adjustment unit to receive the first product and the second product and determine a backlight brightness value according to a difference between the first product and the second product. The mapping ratio transforming unit is electrically connected with the backlight calculating unit to receive the backlight brightness value and transform the backlight brightness value into a backlight mapping reference ratio. The mapping ratio determining unit is electrically connected with the mapping ratio transforming unit to output a minimum of a plurality of backlight mapping reference ratios sequentially received by means of the mapping ratio transforming unit and serve the minimum as the backlight mapping ratio.

In an embodiment of the invention, the boundary adjustment unit includes a first multiplier and a second multiplier. The first multiplier receives the maximum brightness reference value and the first regulation coefficient to provide the first product. The second multiplier receives the minimum brightness reference value and the second regulation coefficient to provide the second product.

In an embodiment of the invention, according to the red original data, the blue original data and the green original data received in a previous frame period, the image analysis unit sequentially receives the red original data, the blue original data and the green original data and sequentially provides the maximum brightness reference value and the minimum brightness reference value.

In an embodiment of the invention, the data transforming unit includes a color data transforming unit, a color temperature (CT) regulating unit, a color-shift compensating unit and an image data output unit. The color data transforming unit receives the backlight mapping ratio, the red original data, the blue original data and the green original data to produce red initial data, blue initial data, green initial data and white initial dat. The CT regulating unit is electrically connected with the color data transforming unit to perform CT regulation on the red initial data, the blue initial data, the green initial data and the white initial data corresponding to a CT range to provide the red reference data, the blue reference data, the green reference data and the white reference data. The color-shift compensating unit is electrically connected with the CT regulating unit to receive the blue reference data and the white reference data to regulate the blue reference data according to the blue component brightness corresponding to the white reference data to provide blue reforming data. The image data output unit is electrically connected with the CT regulating unit and the color-shift compensating unit to receive the red reference data, the blue reforming data, the green reference data and the white reference data and correspondingly provide the red data, the blue data, the green data and the white data.

In an embodiment of the invention, the data transforming unit further includes a backlight driving unit receiving the backlight mapping ratio to provide a backlight control signal.

In an embodiment of the invention, the color-shift compensating unit includes a component determining unit, a blue-color regulating unit and a subtractor. The component determining unit receives the white reference data to provide a blue component reference value. The blue-color regulating unit receives the blue reference data to provide a blue offset value. The subtractor receives the blue component reference value and the blue offset value to provide a blue compensation reference value. The blue-color regulating unit subtracts the blue compensation reference value from a brightness value corresponding to the blue reference data to provide the blue reforming data.

In an embodiment of the invention, a light-penetrable area of the red sub-pixel is equal to a light-penetrable area of the green sub-pixel, the light-penetrable area of the green sub-pixel is greater than or equal to a light-penetrable area of the white sub-pixel, and the light-penetrable area of the white sub-pixel is greater than a light-penetrable area of the blue sub-pixel.

The invention is directed to a method for color transforming of a display apparatus, where the display apparatus has a display panel, a driving circuit and a data processing unit, and the driving circuit drives a red sub-pixel, a blue sub-pixel, a green sub-pixel and a white sub-pixel of the display panel according to red data, blue data, green data and white data. The method for color transforming includes the following steps. Red original data, blue original data and green original data are received by means of the data processing unit to produce red reference data, blue reference data, green reference data and white reference data. The red reference data, the green reference data and the white reference data are output to serve as the red data, the green data and the white data, and the blue reference data is regulated according to blue component brightness corresponding to the white reference data by means of the data processing unit to provide blue data.

In an embodiment of the invention, the method further includes producing the red reference data, the blue reference data, the green reference data and the white reference data according a backlight mapping ratio, the red original data, the blue original data and the green original data by means of the data processing unit.

In an embodiment of the invention, the step of producing the red reference data, the blue reference data, the green reference data and the white reference data according the backlight mapping ratio, the red original data, the blue original data and the green original data by means of the data processing unit includes: expanding the red original data, the blue original data and the green original data based on the backlight mapping ratio by means of the data processing unit; obtaining a minimum brightness expansion value from the expanded red original data, blue original data and green original data by means of the data processing unit; determining the white reference data according to the minimum brightness expansion value by means of the data processing unit; and subtracting a brightness value corresponding to the white reference data from a brightness value corresponding to each of the red original data, the blue original data and the green original data by means of the data processing unit to determine the red reference data, the blue reference data and the green reference data. The brightness value corresponding to the white reference data is less than the minimum brightness expansion value.

In an embodiment of the invention, the brightness value corresponding to the white reference data is half of the minimum brightness expansion value.

In an embodiment of the invention, the method further includes determining the backlight mapping ratio according to the red original data, the blue original data and the green original data received in a previous frame period by means of the data processing unit.

In an embodiment of the invention, the step of determining the backlight mapping ratio according to the red original data, the blue original data and the green original data received in the previous frame period by means of the data processing unit includes: obtaining a maximum brightness reference value and a minimum brightness reference value from the brightness values corresponding to the red original data, the blue original data and the green original data by means of the data processing unit; determining a backlight brightness value according to a difference between a first product of the maximum brightness reference value multiplied by a first regulation coefficient and a second product of the minimum brightness reference value multiplied by a second regulation coefficient by means of the data processing unit; and determining the backlight mapping ratio according to the backlight brightness value by means of the data processing unit.

In an embodiment of the invention, the backlight mapping ratio is a reciprocal of the backlight brightness value.

In an embodiment of the invention, the first regulation coefficient is greater than 0, and the second regulation coefficient is less than or equal to 1.

In an embodiment of the invention, the method further includes: determining a backlight control signal according to the backlight mapping ratio by means of the data processing unit.

In an embodiment of the invention, the backlight control signal is corresponding to a product of a reciprocal of the backlight mapping ratio multiplied by means of the first regulation coefficient.

In an embodiment of the invention, the step of regulating the blue reference data according to the blue component brightness corresponding to the white reference data to provide blue data includes: subtracting the blue component brightness corresponding to the white reference data from a brightness value corresponding to the blue reference data by means of the data processing unit to determine the blue data.

In an embodiment of the invention, the red reference data, the blue reference data, the green reference data and the white reference data are results of pedal ing CT regulation corresponding to a CT range.

To sum up, in the display apparatus and the method for color transforming thereof according to the embodiments of the invention, the blue reference data is regulated according to the blue component brightness corresponding to the white reference data to provide the blue data, and thereby, the color shift issue occurring in the multi-primary color display can be mitigated.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
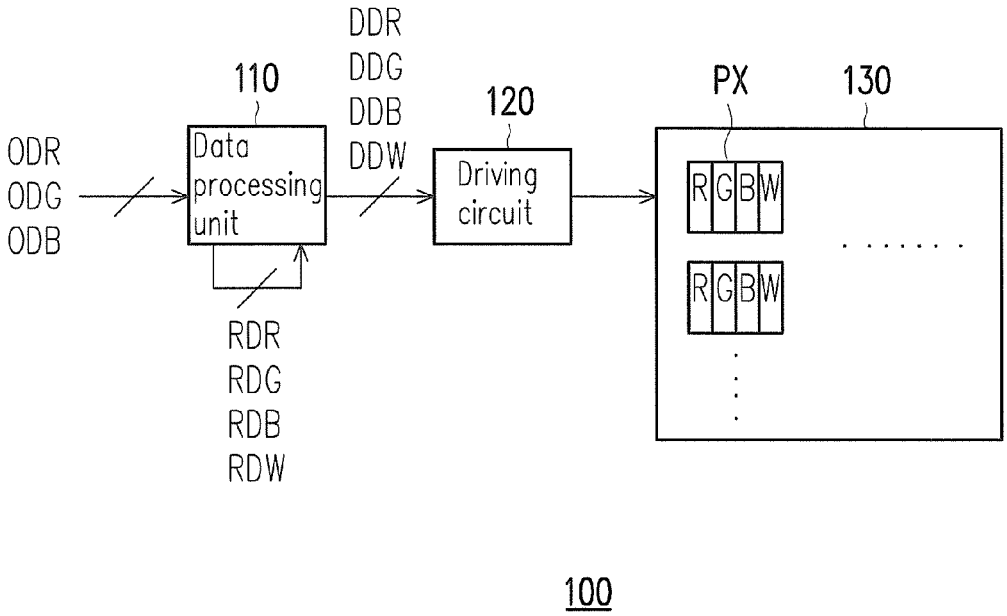
FIG. 1 is a system schematic diagram of a display apparatus according to an embodiment of the invention.

FIG. 1 is a system schematic diagram of a display apparatus according to an embodiment of the invention. Referring to FIG. 1, in the present embodiment, a display apparatus 100 includes a data processing unit 110, a driving circuit 120 and a display panel 130. The data processing unit 110 receives red original data ODR, blue original data ODB and green original data ODG to produce red reference data RDR, blue reference data RDB, green reference data RDG and white reference data RDW, outputs the red reference data RDR, the green reference data RDG and the white reference data RDW to serve as red data DDR, green data DDG and white data DDW and regulates the blue reference data RDB according to blue component brightness corresponding to the white reference data DDW to provide blue data DDB.

The display panel 130 has a plurality of pixels PX arranged in an array, for example, by the invention is not limited thereto, and each of the pixels PX includes a red sub-pixel R, a blue sub-pixel B, a green sub-pixel G and a white sub-pixel W. The driving circuit 120 is electrically connected with the data processing unit 110 and the display panel 130 to receive the red data DDR, the blue data DDB, the green data DDG and the white data DDW. In the meantime, the driving circuit 120 drives a red sub-pixel R according to the red data DDR, drives a blue sub-pixel B according to the blue data DDB, drives a green sub-pixel according to the green data DDG and drives the white sub-pixel W according to the white data DDW.

In an embodiment of the invention, a light-penetrable area of the red sub-pixel R may be equal to a light-penetrable area of the green sub-pixel G, the light-penetrable area of the green sub-pixel G may be greater than or equal to a light-penetrable area of the white sub-pixel W, and the light-penetrable area of the white sub-pixel W may be greater than a light-penetrable area of the blue sub-pixel B to mitigate color shift occurring in the display panel 130.

Figure 2:
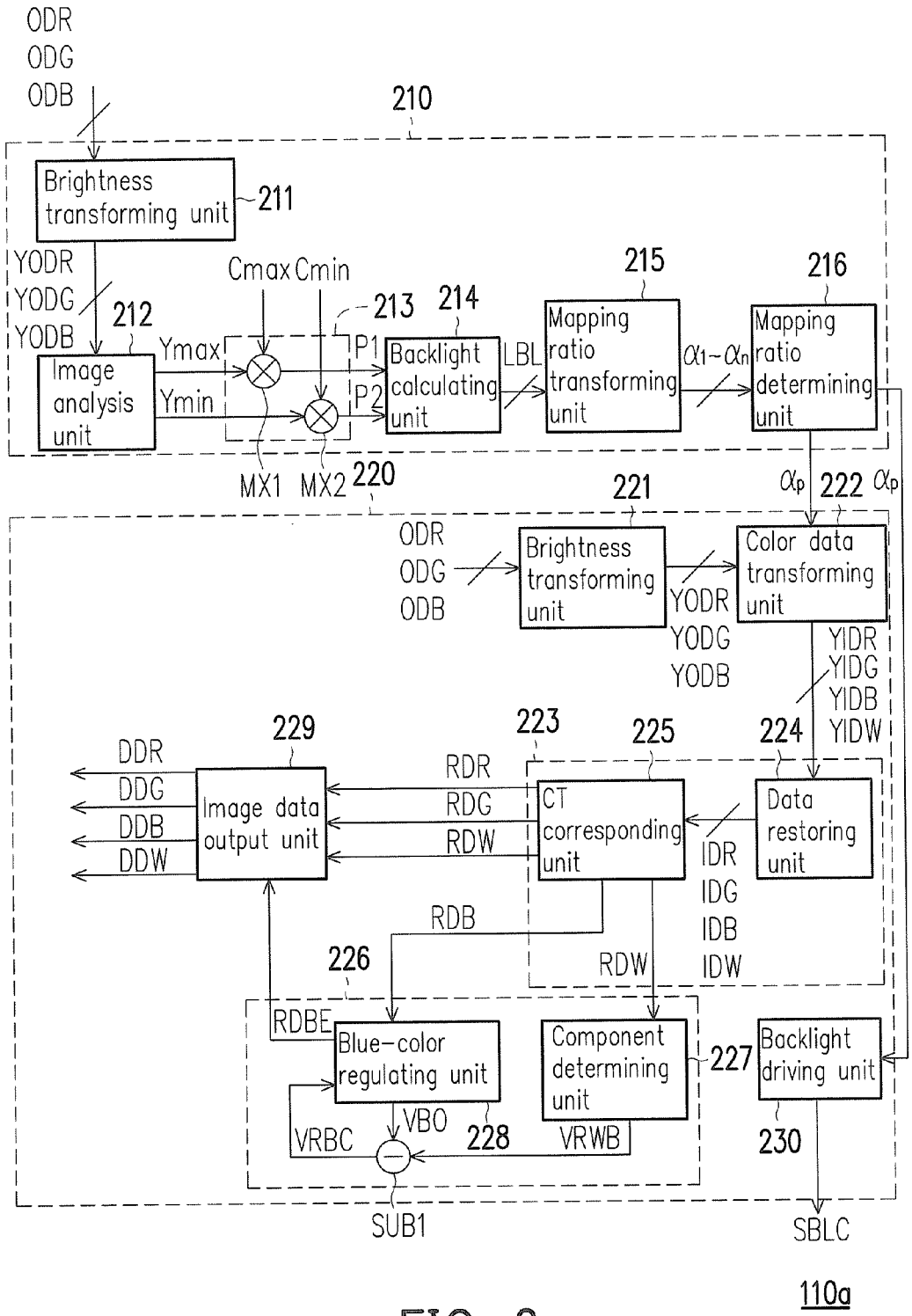
FIG. 2 is a system schematic diagram of the data processing unit depicted in FIG. 1 according to an embodiment of the invention.

FIG. 2 is a system schematic diagram of the data processing unit depicted in FIG. 1 according to an embodiment of the invention. Referring to FIG. 1 and FIG. 2, the same or similar reference numbers are used to refer to the same or like parts. In the present embodiment, a data processing unit 110*a* includes, for example, a numerical calculating unit 210 and a data transforming unit 220.

The numerical calculating unit 210 receives the red original data ODR, the blue original data ODB and the green original data ODG to determine a backlight mapping ratio $\alpha_p$. The data transforming unit 220 receives the red original data ODR, the blue original data ODB, the green original data ODG and the backlight mapping ratio $\alpha_p$ to produce the red reference data RDR, the blue reference data RDB, the green reference data RDG and the white reference data RDW. Then, the data transforming unit 220 outputs the red reference data RDR, the green reference data RDG and the white reference data RDW to serve as the red data DDR, the green data DDG and the white data DDW and regulates the blue reference data RDB according to blue component brightness corresponding to the white reference data RDW to provide the blue data DDB. Meanwhile, when the display panel 130 displays by using light from a backlight module (not shown), the data transforming unit 220 may produce a backlight control signal SBLC according to the backlight mapping ratio $\alpha_p$ to control the backlight module (not shown) of the display apparatus 100.

In an embodiment of the invention, the numerical calculating unit 210 may receive the red original data ODR, the blue original data ODB and the green original data ODG of a previous frame period to determine the backlight mapping ratio $\alpha_p$, and the data transforming unit 220 may produce the red data DDR, the blue data DDB, the green data DDG and the white data DDW for displaying the current image frame according to the red original data ODR, the blue original data ODB and the green original data ODG of the current frame period.

Furthermore, the numerical calculating unit 210 includes a brightness transforming unit 211, an image analysis unit 212, a boundary adjustment unit 213, a backlight calculating unit 214, a mapping ratio transforming unit 215 and a mapping ratio determining unit 216. The brightness transforming unit 211 receives the red original data ODR, the blue original data ODB and the green original data ODG to transform the red original data ODR, the blue original data ODB and the green original data ODG representing gray level values into brightness values YODR, YODB and YODG. After receiving the brightness values YODR, YODB and YODG corresponding to the red original data ODR, the blue original data ODB and the green original data ODG of the same pixel PX, the image analysis unit 212 obtains a maximum brightness reference value Ymax and a minimum brightness reference value Ymin from the brightness values YODR, YODB and YODG.

The boundary adjustment unit 213 is electrically connected with the image analysis unit 212 to receive the maximum brightness reference value Ymax and the minimum brightness reference value Ymin corresponding to each pixel PX and provides a first product P1 of the maximum brightness reference value Ymax multiplied by a first regulation coefficient Cmax and a second product P2 of the minimum brightness reference value Ymin multiplied by the second regulation coefficient Cmin. The first regulation coefficient Cmax is greater than 0, the second regulation coefficient Cmin is less than or equal to 1. In the present embodiment, the boundary adjustment unit 213 includes, for example, a first multiplier MX1 and a second multiplier MX2. The first multiplier MX1 receives the maximum brightness reference value Ymax and the first regulation coefficient Cmax to provide the first product P1. The second multiplier M2 receives the minimum brightness reference value Ymin and the second regulation coefficient Cmin to provide the second product P2.

The backlight calculating unit 214 is electrically connected with the boundary adjustment unit 213 to receive the first product P1 and the second product P2 corresponding to each pixel PX and determines a backlight brightness value LBL corresponding to each pixel PX according to a difference between the first product P1 and the second product P2, i.e., LBL=P1−P2=Cmax×Ymax−Cmin×Ymin. The mapping ratio transforming unit 215 is electrically connected with the backlight calculating unit 214 to receive the backlight brightness value LBL corresponding to each pixel PX and transforms the backlight brightness values LBL corresponding to all the pixels PX into backlight mapping reference ratios $\alpha_1$ to $\alpha_n$, where n is a number of the pixels PX, and the backlight mapping reference ratios $\alpha_1$ to $\alpha_n$ are reciprocals corresponding to the backlight brightness values LBL. In an embodiment of the invention, a look up table (LUT) may be built in the mapping ratio transforming unit 215 for the transformation of the backlight brightness values LBL.

The mapping ratio determining unit 216 is electrically connected with the mapping ratio transforming unit 215 to output a minimum of the backlight mapping reference ratio $\alpha_1$ to $\alpha_n$ sequentially received from the mapping ratio transforming unit 215 to serve the minimum value as the backlight mapping ratio ap.

In an embodiment of the invention, the image analysis unit 212 sequentially receives the red original data ODR, the blue original data ODB and the green original data ODG of the previous frame period through the brightness transforming unit 211 and sequentially provides the maximum brightness reference value Ymax and the minimum brightness reference value Ymin corresponding to each pixel PX.

The data transforming unit 220 includes a brightness transforming unit 221, a color data transforming unit 222, a color temperature (CT) regulating unit 223, a color-shift compensating unit 226, an image data output unit 229 and a backlight driving unit 230. The brightness transforming unit 221 receives the red original data ODR, the blue original data ODB and the green original data ODG to transform the red original data ODR, the blue original data ODB and the green original data ODG representing the gray level values into the brightness values YODR, YODB and YODG.

The color data transforming unit 222 receives the backlight mapping ratio $\alpha_p$ and the brightness values YODR, YODB and YODG corresponding to the red original data ODR, the blue original data ODB and the green original data ODG to produce brightness values YIDR, YIDB, YIDG and YIDW corresponding to red initial data IDR, blue initial data IDB, green initial data IDG and white initial data IDW.

Furthermore, the color data transforming unit 222 expands the brightness values YODR, YODB and YODG corresponding to the red original data ODR, the blue original data ODB and the green original data ODG according to the backlight mapping ratio $\alpha_p$, that is, multiplies each of the brightness values YODR, YODB and YODG with the backlight mapping ratio $\alpha_p$, and then, selects a minimum from products of the brightness values YODR, YODB and YODG respectively multiplied by the backlight mapping ratio $\alpha_p$, that is, selects a minimum brightness expansion value from the expanded brightness values YODR, YODB and YODG. The color data transforming unit 222 determines the brightness value YIDW corresponding to the white initial data IDW according to the minimum brightness expansion value, where the brightness value corresponding to the white initial data IDW is less than the minimum brightness expansion value. For example, the brightness value corresponding to the white initial data IDW is half of the minimum brightness expansion value. Lastly, the color data transforming unit 222 respectively subtracts the brightness value YIDW from the products of the brightness values YODR, YODB and YODG respectively multiplied by the backlight mapping ratio $\alpha_p$ and serves the subtraction differences as the brightness values YIDR, YIDB and YIDG corresponding to the red initial data IDR, the blue initial data IDB and the green initial data IDG.

The CT regulating unit 223 is electrically connected with the color data transforming unit 222 to perform CT regulation on the brightness values YIDR, YIDB, YIDG and YIDW corresponding to the red initial data IDR, the blue initial data IDB, the green initial data IDG and the white initial data IDW within a CT range (e.g., within a range of 11000±500° K of a LCD TV) to provide the red reference data RDR, the blue reference data RDB, the green reference data RDG and the white reference data RDW.

In an embodiment of the invention, the CT regulating unit 223 includes a data restoring unit 224 and a CT corresponding unit 225. The data restoring unit 224 receives the brightness values YIDR, YIDB, YID and YIDW to provide the red initial data IDR, the blue initial data IDB, the green initial data IDG and the white initial data IDW. The CT corresponding unit 225 receives the red initial data IDR, the blue initial data IDB, the green initial data IDG and the white initial data IDW to perform the CT regulation on the red initial data IDR, the blue initial data IDB, the green initial data IDG and the white initial data IDW corresponding to the CT range to provide the red reference data RDR, the blue reference data RDB, the green reference data RDG and the white reference data RDW. In this case, a look up table may be built in the CT corresponding unit 225 for performing the CT regulation.

The color-shift compensating unit 226 is electrically connected with the CT regulating unit 223 to receive the blue reference data RDB and the white reference data RDW to regulate the blue reference data RDB according to the blue component brightness YWB corresponding to the white reference data RDW to provide the blue reforming data RDBE.

In an embodiment of the invention, the color-shift compensating unit 226 includes a component determining unit 227, a blue-color regulating unit 228 and a subtractor SUB 1. The component determining unit 227 receives the white reference data RDW to provide a blue component reference value VRWB. In this case, a look up table may be built in the component determining unit 227 for looking up the blue component. The blue-color regulating unit 228 receives the blue reference data RDB to provide a blue offset value VBO, where the blue offset value VBO may be a loss of the blue component after performing the CT regulation, but the invention is not limited thereto. The subtractor SUB 1 receives the blue component reference value VRWB and the blue offset value VBO to provide a blue compensation reference value VRBC, i.e., the blue compensation reference value VRBC is the blue component reference value VRWB minus the blue offset value VBO. Then, the blue-color regulating unit 228 subtracts the blue compensation reference value VRBC from the brightness value corresponding to the blue reference data RDB to provide blue reforming data DRBE.

The image data output unit 229 is electrically connected with the CT regulating unit 223 and the color-shift compensating unit 226 to receive the red reference data RDR, the blue reforming data DRBE, the green reference data RDG and the white reference data RDW and correspondingly provides the red data DDR, the blue data DDB, the green data DDG and the white data DDW.

The backlight driving unit 230 receives the backlight mapping ratio $\alpha_p$ to provide a the backlight control signal SBLC, where a duty cycle of the backlight control signal SBLC is the reciprocal of the backlight mapping ratio $\alpha_p$ multiplied by a third regulation coefficient Cbl, and the third regulation coefficient Cbl is greater than 0. In an embodiment of the invention, the third regulation coefficient Cbl may be identical to the first regulation coefficient Cmax.

Figure 3:
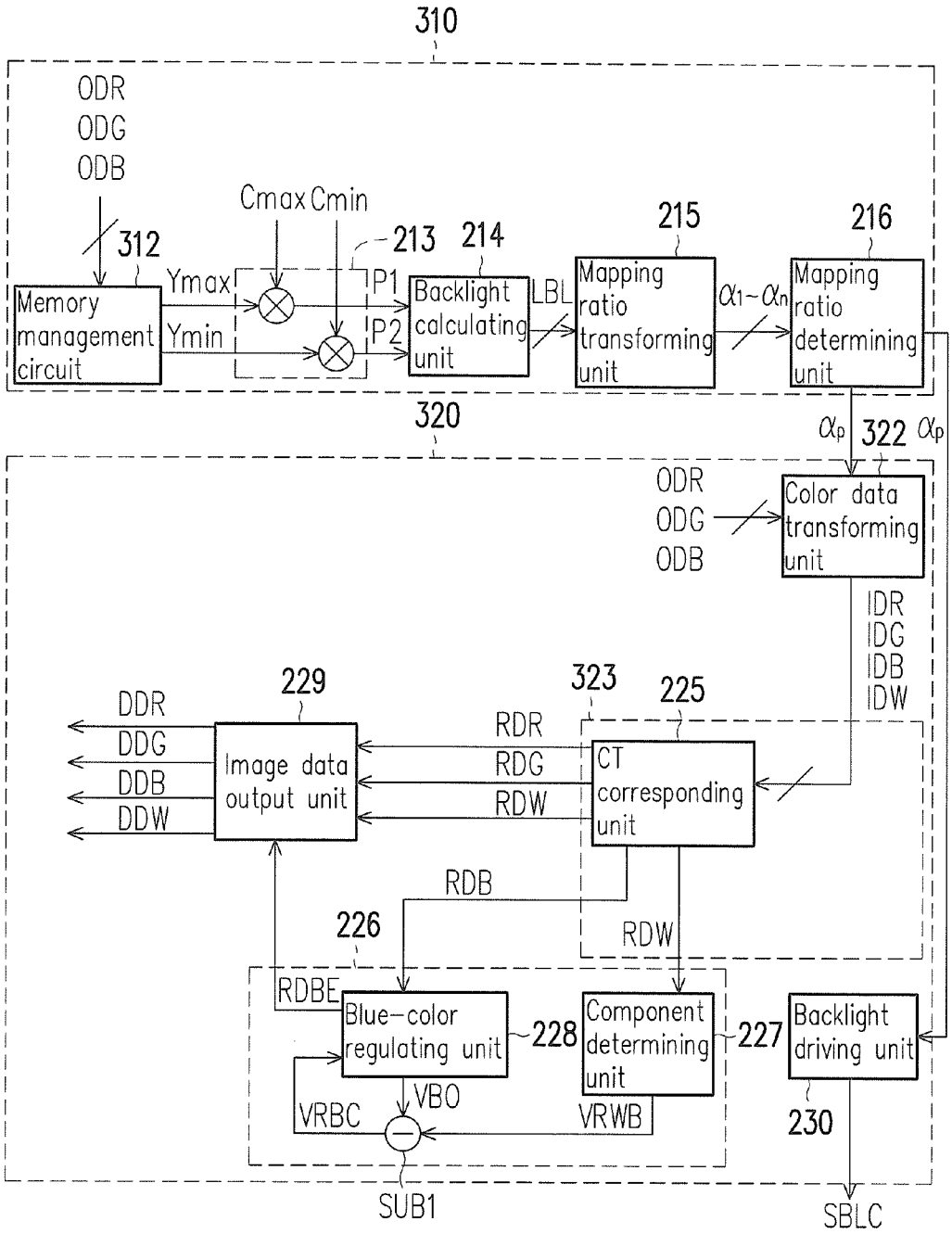
FIG. 3 is a system schematic diagram of the data processing unit depicted in FIG. 1 according to another embodiment of the invention.

FIG. 3 is a system schematic diagram of the data processing unit depicted in FIG. 1 according to another embodiment of the invention. Referring to FIG. 2 and FIG. 3, the same or similar reference numbers are used to refer to the same or like parts. In the present embodiment, a data processing unit 110*b* includes, for example, a numerical calculating unit 310 and a data transforming unit 320.

The numerical calculating unit 310 is substantially the same as the numerical calculating unit 210, but different therefrom in including an image analysis unit 312. The image analysis unit 312 receives the red original data ODR, the blue original data ODB and the green original data ODG to obtain the maximum brightness reference value Ymax and the minimum brightness reference value Ymin from the brightness values corresponding to the red original data ODR, the blue original data ODB and the green original data ODG according to the gray level values represented by the red original data ODR, the blue original data ODB and the green original data ODG.

The data transforming unit 320 is substantially the same as the data transforming unit 220, but different therefrom in including a color data transforming unit 322 and a CT regulating unit 323. The color data transforming unit 322 receives the red original data ODR, the blue original data ODB and the green original data ODG to produce the red initial data IDG, the blue initial data IDB, the green initial data IDG and the white initial data IDW. The color data transforming unit 322 receives the red initial data IDG, the blue initial data IDB, the green initial data IDG and the white initial data IDW to perform the CT regulation on the red initial data IDG, the blue initial data IDB, the green initial data IDG and the white initial data IDW corresponding to a CT range to provide the red reference data RDR, the blue reference data RDB, the green reference data RDG and the white reference data RDW. That is, in this case, the data restoring unit 224 may be omitted from the color data transforming unit 322.

Figure 4:
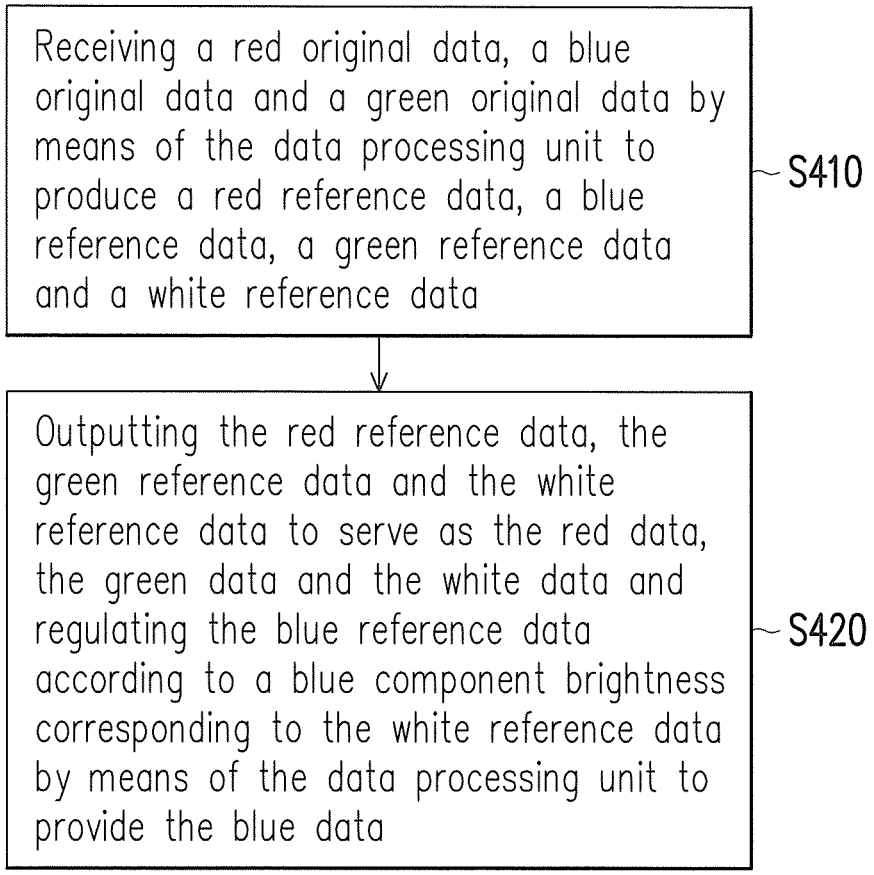
FIG. 4 is a flowchart of a method for color transforming of a display apparatus according to an embodiment of the invention.

FIG. 4 is a flowchart of a method for color transforming of a display apparatus according to an embodiment of the invention. Referring to FIG. 4, a display apparatus has a display panel, a driving circuit and a data processing unit, and the driving circuit drives a red sub-pixel, a blue sub-pixel, a green sub-pixel and a white sub-pixel of the display panel according to red data, blue data, green data and white data. The method for color transforming includes the following steps. In step S410, the data processing unit receives red original data, blue original data and green original data to produce red reference data, blue reference data, green reference data and white reference data. In step S420, the data processing unit outputs the red reference data, the green reference data and the white reference data to serve as the red data, the green data and the white data and regulates the blue reference data according to blue component brightness corresponding to the white reference data to provide the blue data. The order of steps S410 and S420 is illustrated for description but construes no limitations to the present embodiment. Details with respect to steps S410 and S420 may refer to the embodiments illustrated in FIG. 1 to FIG. 3 and thus, will not be repeatedly described.

Based on the above, in the display apparatus and the method for color transforming thereof according to the embodiments of the invention, the blue reference data is regulated according to the blue component brightness corresponding to the white reference data to provide the blue data and thereby, the color shift issue occurring in the multi-primary color display can be mitigated.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A display apparatus, comprising:

a display panel, having a red sub-pixel, a blue sub-pixel, a green sub-pixel and a white sub-pixel;

a driving circuit, electrically connected with the display panel and receiving a red data, a blue data, a green data and a white data to drive the red sub-pixel, the blue sub-pixel, the green sub-pixel and the white sub-pixel; and a data processing unit, receiving a red original data, a blue original data and a green original data to produce a red reference data, a blue reference data, a green reference data and a white reference data, outputting the red reference data, the green reference data and the white reference data to serve as the red data, the green data and the white data and regulating the blue reference data according to a blue component brightness corresponding to the white reference data to provide the blue data.

2. The display apparatus according to claim 1, wherein the data processing unit comprises:

a numerical calculating unit, receiving the red original data, the blue original data and the green original data to determine a backlight mapping ratio; and a data transforming unit, receiving the red original data, the blue original data, the green original data and the backlight mapping ratio to produce the red reference data, the blue reference data, the green reference data and the white reference data, outputting the red reference data, the green reference data and the white reference data to serve as the red data, the green data and the white data and regulating the blue reference data according to the blue component brightness corresponding to the white reference data to provide the blue data.

3. The display apparatus according to claim 2, wherein the numerical calculating unit comprises:

an image analysis unit, receiving the red original data, the blue original data and the green original data to obtain a maximum brightness reference value and a minimum brightness reference value from brightness values corresponding to the red original data, the blue original data and the green original data;

a boundary adjustment unit, electrically connected with the image analysis unit to receive the maximum brightness reference value and the minimum brightness reference value and provide a first product of the maximum brightness reference value multiplied by means of a first regulation coefficient and a second product of the minimum brightness reference value multiplied by means of a second regulation coefficient;

a backlight calculating unit, electrically connected with the boundary adjustment unit to receive the first product and the second product and determining a backlight brightness value according to a difference between the first product and the second product;

a mapping ratio transforming unit, electrically connected with the backlight calculating unit to receive the backlight brightness value and transform the backlight brightness value into a backlight mapping reference ratio; and a mapping ratio determining unit, electrically connected with the mapping ratio transforming unit to output a minimum of a plurality of backlight mapping reference ratios sequentially received by means of the mapping ratio transforming unit to serve as the backlight mapping ratio.

4. The display apparatus according to claim 3, wherein the backlight mapping reference ratio is a reciprocal of the backlight brightness value.

5. The display apparatus according to claim 3, wherein the first regulation coefficient is greater than 0, and the second regulation coefficient is less than or equal to 1.

6. The display apparatus according to claim 3, wherein the boundary adjustment unit comprises:

a first multiplier, receiving the maximum brightness reference value and the first regulation coefficient to provide the first product; and a second multiplier, receiving the minimum brightness reference value and the second regulation coefficient to provide the second product.

7. The display apparatus according to claim 3, wherein according to the red original data, the blue original data and the green original data received in a previous frame period, the image analysis unit sequentially receives the red original data, the blue original data and the green original data and sequentially provides the maximum brightness reference value and the minimum brightness reference value.

8. The display apparatus according to claim 2, wherein the data transforming unit comprises:

a color data transforming unit, receiving the backlight mapping ratio, the red original data, the blue original data and the green original data to produce a red initial data, a blue initial data, a green initial data and a white initial data;

a color temperature (CT) regulating unit, electrically connected with the color data transforming unit to perform CT regulation on the red initial data, the blue initial data, the green initial data and the white initial data corresponding to a CT range to provide the red reference data, the blue reference data, the green reference data and the white reference data;

a color-shift compensating unit, electrically connected with the CT regulating unit to receive the blue reference data and the white reference data to regulate the blue reference data according to the blue component brightness corresponding to the white reference data to provide a blue reforming data; and an image data output unit, electrically connected with the CT regulating unit and the color-shift compensating unit to receive the red reference data, the blue reforming data, the green reference data and the white reference data and correspondingly provide the red data, the blue data, the green data and the white data.

9. The display apparatus according to claim 8, wherein the data transforming unit further comprises:

a backlight driving unit, receiving the backlight mapping ratio to provide a backlight control signal.

10. The display apparatus according to claim 9, wherein the backlight control signal corresponding to a product of the reciprocal of the backlight mapping ratio multiplied by means of a third regulation coefficient.

11. The display apparatus according to claim 10, wherein the third regulation coefficient is greater than 0.

12. The display apparatus according to claim 8, wherein the color-shift compensating unit comprises:

a component determining unit, receiving the white reference data to provide a blue component reference value;

a blue-color regulating unit, receiving the blue reference data to provide a blue offset value; and a subtractor, receiving the blue component reference value and the blue offset value to provide a blue compensation reference value, wherein the blue-color regulating unit subtracts the blue compensation reference value from a brightness value corresponding to the blue reference data to provide the blue reforming data.

13. The display apparatus according to claim 1, wherein a light-penetrable area of the red sub-pixel is equal to a light-penetrable area of the green sub-pixel, the light-penetrable area of the green sub-pixel is greater than or equal to a light-penetrable area of the white sub-pixel, and the light-penetrable area of the white sub-pixel is greater than a light-penetrable area of the blue sub-pixel.

14. A method for color transforming of a display apparatus, wherein the display apparatus has a display panel, a driving circuit and a data processing unit, the driving circuit drives a red sub-pixel, a blue sub-pixel, a green sub-pixel and a white sub-pixel of the display panel according to a red data, a blue data, a green data and a white data, the method for color transforming comprising:

receiving a red original data, a blue original data and a green original data by means of the data processing unit to produce a red reference data, a blue reference data, a green reference data and a white reference data; and outputting the red reference data, the green reference data and the white reference data to serve as the red data, the green data and the white data and regulating the blue reference data according to a blue component brightness corresponding to the white reference data by means of the data processing unit to provide the blue data.

15. The method according to claim 14, further comprising:

producing the red reference data, the blue reference data, the green reference data and the white reference data according a backlight mapping ratio, the red original data, the blue original data and the green original data by means of the data processing unit.

16. The method according to claim 15, wherein the step of producing the red reference data, the blue reference data, the green reference data and the white reference data according the backlight mapping ratio, the red original data, the blue original data and the green original data by means of the data processing unit comprises:

expanding the red original data, the blue original data and the green original data based on the backlight mapping ratio by means of the data processing unit;

obtaining a minimum brightness expansion value from the expanded red original data, blue original data and green original data by means of the data processing unit;

determining the white reference data according to the minimum brightness expansion value by means of the data processing unit; and subtracting a brightness value corresponding to the white reference data from a brightness value corresponding to each of the expanded red original data, the expanded blue original data and the expanded green original data by means of the data processing unit to determine the red reference data, the blue reference data and the green reference data;

wherein the brightness value corresponding to the white reference data is less than the minimum brightness expansion value.

17. The method according to claim 16, wherein the brightness value corresponding to the white reference data is half of the minimum brightness expansion value.

18. The method according to claim 15, further comprising:

determining the backlight mapping ratio according to the red original data, the blue original data and the green original data received in a previous frame period by means of the data processing unit.

19. The method according to claim 18, wherein the step of determining the backlight mapping ratio according to the red original data, the blue original data and the green original data received in the previous frame period by means of the data processing unit comprises:

obtaining a maximum brightness reference value and a minimum brightness reference value from the brightness values corresponding to the red original data, the blue original data and the green original data by means of the data processing unit;

determining a backlight brightness value according to a difference between a first product of the maximum brightness reference value multiplied by a first regulation coefficient and a second product of the minimum brightness reference value multiplied by a second regulation coefficient by means of the data processing unit; and determining the backlight mapping ratio according to the backlight brightness value by means of the data processing unit.

20. The method according to claim 19, wherein the backlight mapping ratio is a reciprocal of the backlight brightness value.

21. The method according to claim 19, wherein the first regulation coefficient is greater than 0, and the second regulation coefficient is less than or equal to 1.

22. The method according to claim 19, further comprising:

determining a backlight control signal according to the backlight mapping ratio by means of the data processing unit.

23. The method according to claim 22, wherein the backlight control signal is corresponding to a product of a reciprocal of the backlight mapping ratio multiplied by means of the first regulation coefficient.

24. The method according to claim 14, wherein the step of regulating the blue reference data according to the blue component brightness corresponding to the white reference data to provide the blue data comprises:

subtracting the blue component brightness corresponding to the white reference data from a brightness value corresponding to the blue reference data by means of the data processing unit to determine the blue data.

25. The method according to claim 14, wherein the red reference data, the blue reference data, the green reference data and the white reference data are results of performing CT regulation corresponding to a CT range.

* * * * *